US006749357B2

(12) United States Patent
Cheng

(10) Patent No.: US 6,749,357 B2
(45) Date of Patent: Jun. 15, 2004

(54) RING BINDER MECHANISM

(75) Inventor: Hung Yu Cheng, Siu Lek Yuen Shatin (CN)

(73) Assignee: World Wide Stationery Manufacturing Company, Limited, Kwai Chung (HK)

( * ) Notice: Subject to any disclaimer, the term of this patent is extended or adjusted under 35 U.S.C. 154(b) by 397 days.

(21) Appl. No.: 09/683,205

(22) Filed: Nov. 30, 2001

(65) Prior Publication Data

US 2003/0103797 A1 Jun. 5, 2003

(51) Int. Cl.[7] ..... B42F 13/02
(52) U.S. Cl. ..... 402/19; 402/38
(58) Field of Search ..... 402/19, 20, 24, 402/26, 28, 31, 36, 37, 38, 39, 41, 70, 16

(56) References Cited

U.S. PATENT DOCUMENTS

| | | | |
|---|---|---|---|
| 2,204,918 A | 6/1940 | Trussell | |
| 2,218,105 A | 10/1940 | Griffin | |
| 3,098,490 A | 7/1963 | Wance | |
| 3,884,586 A | 5/1975 | Michaelis et al. | |
| 3,954,343 A | 5/1976 | Thomsen | |
| 4,130,368 A | 12/1978 | Jacoby et al. | |
| 4,566,817 A | 1/1986 | Barrett, Jr. | |
| 4,571,108 A | 2/1986 | Vogl | |
| 4,813,803 A | 3/1989 | Gross | |
| 5,116,157 A | 5/1992 | Gillum et al. | |
| 5,286,128 A | 2/1994 | Gillum | |
| 6,036,394 A | 3/2000 | Cheng | |
| 6,276,862 B1 | 8/2001 | Snyder et al. | |
| 6,293,722 B1 * | 9/2001 | Holbrook et al. | 402/35 |
| 6,364,558 B1 | 4/2002 | To | |

FOREIGN PATENT DOCUMENTS

| | | |
|---|---|---|
| GB | 952536 | 3/1964 |
| GB | 2 292 343 A | 2/1996 |
| WO | WO01/19620 A1 | 3/2001 |
| WO | WO01/81099 A1 | 11/2001 |

OTHER PUBLICATIONS

Kokuyo Lock Ring Mechanism with description, two instruction sheets, and nine photographs, undated but admitted as prior art.

European Search Report from the European Patent Office dated Feb. 27, 2003.

* cited by examiner

*Primary Examiner*—Derris H. Banks
*Assistant Examiner*—Jamila Williams
(74) *Attorney, Agent, or Firm*—Senniger, Powers, Leavitt & Roedel

(57) ABSTRACT

A ring binder mechanism for retaining loose leaf pages. The mechanism includes an elongate plate, hinge plates supported by the plate for pivoting motion relative to the plate, and ring members mounted on the hinge plates which are moveable between a closed position and an open position. A control structure controllably pivots the hinge plates to thereby move the ring members between the closed and open positions. The control structure includes a single actuator at one end of the mechanism, a travel bar movable relative to the elongate plate, and two connecting links operatively connecting the travel bar to the hinge plates. The control structure is configured to selectively place the mechanism in a locked position wherein the ring members are securely closed.

21 Claims, 16 Drawing Sheets

RING BINDER MECHANISM

BACKGROUND OF THE INVENTION

This invention relates to binders for holding loose leaf pages, and in particular to an improved mechanism for opening and closing binders.

A ring binder retains loose leaf pages, such as hole-punched papers, in a file or notebook. It features ring members for retaining the papers which may be selectively opened to add or remove papers, or closed to retain papers while allowing them to be moved along the ring members. Levers are typically provided on both ends of the binder for moving the ring members between the open and closed positions.

One drawback to ring binders of the prior art is that when ring members are being closed, they snap shut with a strong magnitude of force which can cause injury. When ring members are fully closed, that strong clamping force is necessary to securely lock the binder and prevent its unintentional opening. Unfortunately, that magnitude of force is also applied to the ring members while they are being opened or closed, causing difficulty in opening and closing the ring members, as well as the hazardous snapping action. Further, the clamping force within each ring is not uniform with the clamping force in other rings, causing uneven movement and potentially resulting in gaps on closed rings.

SUMMARY OF THE INVENTION

Among the several objects and features of the present invention may be noted the provision of a ring binder mechanism which inhibits injury to operators; the provision of such a mechanism which is easily opened or closed; the provision of such a mechanism which provides uniform clamping force in each ring; and the provision of such a mechanism which may be securely locked.

Generally, a ring binder mechanism according to the present invention retains loose leaf pages. The mechanism comprises a generally rigid, elongate plate having a longitudinal axis and hinge plates supported by the plate for pivoting motion relative to the elongate plate. Rings hold the loose leaf pages, the rings including ring members mounted on the hinge plates and moveable by the hinge plates between a closed position wherein the ring members of each ring form a substantially continuous, closed loop for allowing loose leaf pages retained by the rings to be moved along the ring from one ring member to the other, and an open position wherein the ring members of each ring form a discontinuous, open loop for adding or removing loose leaf pages from the rings. A control structure is supported by the elongate plate for movement relative to the elongate plate for controllably pivoting the hinge plates to thereby move the ring members between the closed and open positions. The control structure comprises a travel bar movable in translation relative to the elongate plate and a connecting link pivotally connecting the travel bar to the hinge plates for moving the hinge plates between the closed and open positions.

In another aspect, a ring binder mechanism according to the present invention comprises a generally rigid, elongate plate having a longitudinal axis and two ends. Hinge plates are supported by the elongate plate for pivoting motion relative to the elongate plate. Rings hold the loose leaf pages, the rings including ring members mounted on the hinge plates and moveable by the hinge plates between a closed position wherein the ring members of each ring form a substantially continuous, closed loop for allowing loose leaf pages retained by the rings to be moved along the ring from one ring member to the other, and an open position wherein the ring members of each ring form a discontinuous, open loop for adding or removing loose leaf pages from the rings. A control structure is supported by the elongate plate for movement relative to the elongate plate. The control structure comprises a pivotally movable actuator located generally at one end of the elongate plate and pivotally mounted thereto, the other end being free of any actuator. The control structure engages the hinge plates at least at two spaced apart locations for controllably pivoting the hinge plates to thereby move the ring members between the closed and open positions.

In yet a further aspect, a method according to the present invention opens or closes a ring binder mechanism having ring members for retaining loose leaf pages and an elongate support plate. The method comprises the steps of mounting the ring members on pivotable hinge plates such that pivoting of the hinge plates moves the ring members between open and closed positions. The hinge plates are operatively connected with a travel bar that is moveable in translation generally lengthwise of the elongate plate, including placing at least one pivotally movable connecting link between the hinge plates and the travel bar such that force is transmitted from the bar to the hinge plates to produce pivotal motion of the hinge plates. Force is applied to the actuating bar to move the bar and thereby open or close the ring members.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE PREFERRED EMBODIMENT

Figure 1:
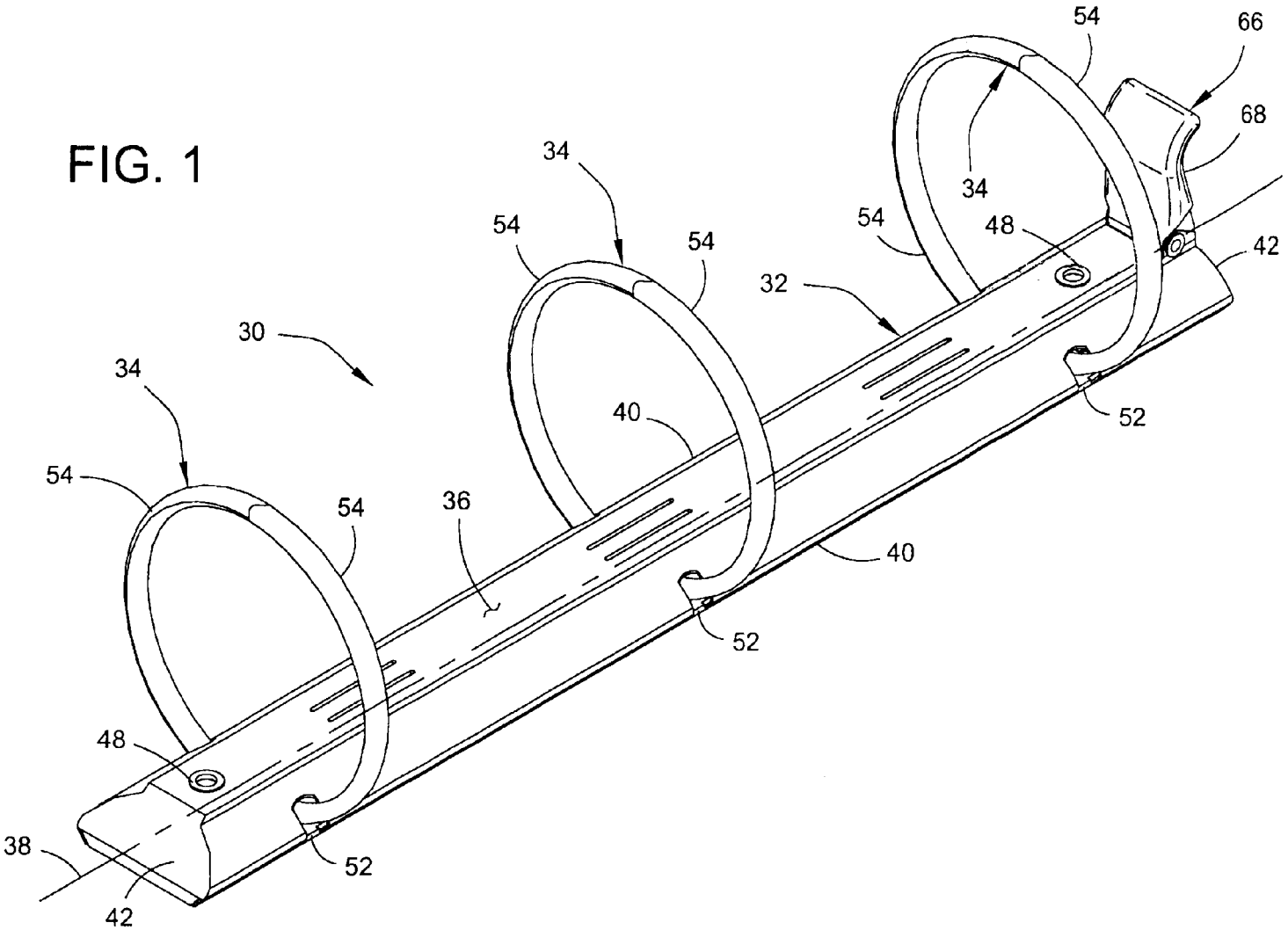
FIG. 1 is a perspective of a ring binder mechanism of the present invention.

Referring now to the drawings and in particular to FIG. 1, a ring binder mechanism according to the present invention for retaining loose leaf pages is indicated generally at 30. The mechanism 30 includes an elongate plate 32 and three rings, each indicated generally at 34, for holding loose leaf pages.

Figure 2:
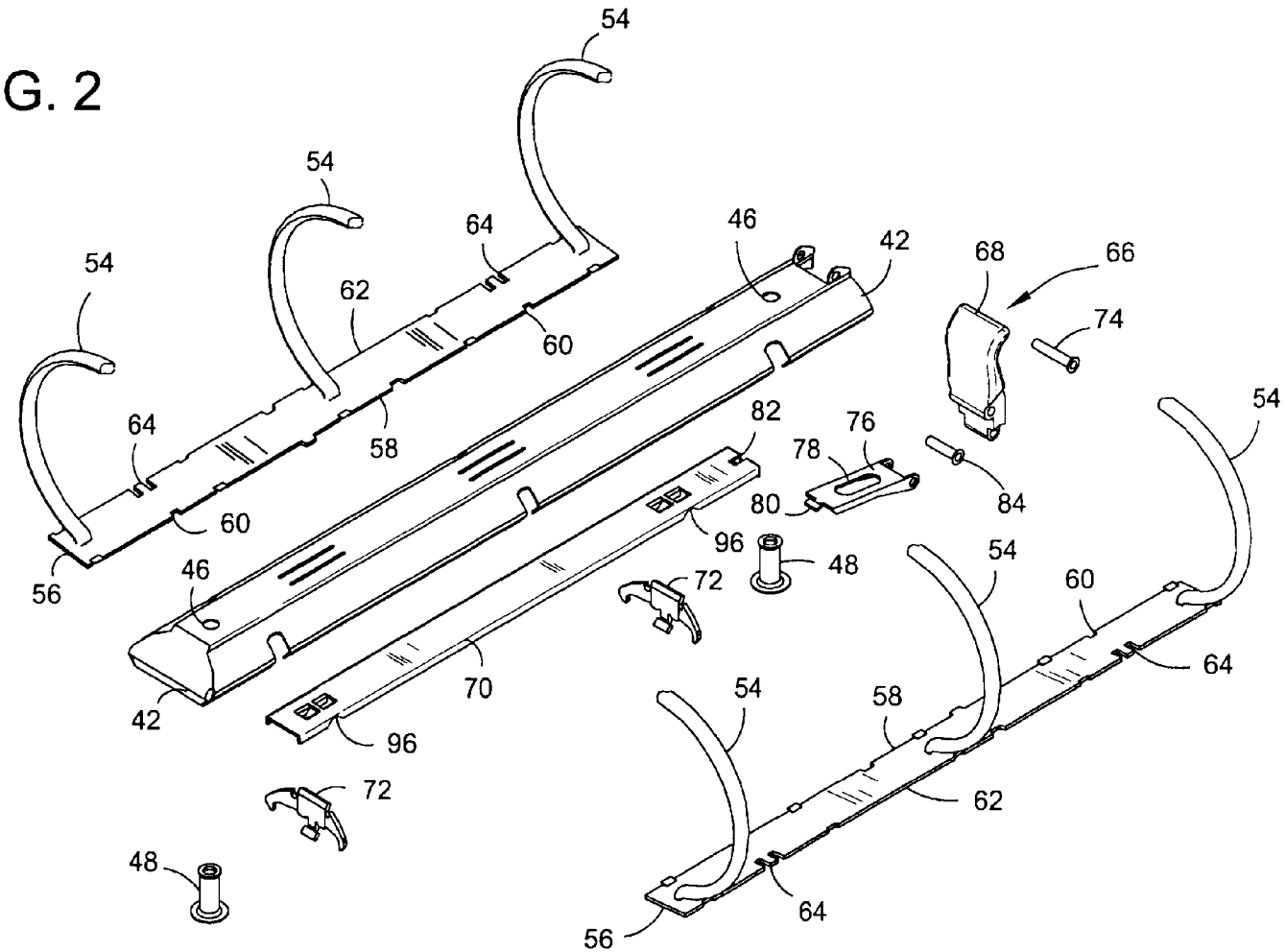
FIG. 2 is an exploded perspective thereof.

The plate 32 is shaped as an elongated rectangle with a uniform, generally arch-shaped elevated profile having at its center a raised plateau 36. The plate 32 has a longitudinal axis 38, two generally opposite longitudinal edges 40, and two generally opposite transverse ends 42. A bent under rim 44 (FIG. 9) is formed along the longitudinal edges 40. The elongate plate 32 is made of metal or other suitable material which is sufficiently rigid to provide a stable mount for other components of the mechanism, while being lightweight to conserve material and manufacturing costs. Two openings 46 (FIG. 2) are provided for receiving and attaching mounting posts 48 to secure the mechanism to a file or notebook 50 (FIG. 11), and six additional holes 52 are positioned along the longitudinal edges 40 to receive the rings therethrough. Mechanisms having plates or housings of other shapes, including irregular shapes, or housings which are integral with a file or notebook, do not depart from the scope of this invention.

Each of the three rings 34 include two half ring members 54 which are movable between a closed position (FIGS. 1 and 3) wherein each ring member forms a continuous, closed loop for retaining loose leaf pages, and an open position (FIG. 5) wherein each ring member forms a discontinuous, open loop suitable for adding or removing pages. The ring members 54 are formed of a conventional, cylindrical rod of a suitable material such as steel. Although both ring members 54 of each ring 34 are movable in the illustrated embodiment, a mechanism having a movable ring member and a fixed ring member does not depart from the scope of this invention. Further, a mechanism with a different number of rings, greater or less than three, does not depart from the scope of this invention.

The ring members 54 are mounted on hinge plates 56 (FIGS. 2 and 3) which are supported by the elongate plate 32 for pivotal motion to move the ring members between the closed and open positions. The hinge plates 56 are mounted in parallel arrangement and attached to each other for pivotal motion along adjoining longitudinal edges to form a hinge 58. Two pairs of aligned notches 60 in the hinge plates 56 are positioned along the hinge and define openings, the use of which will be explained hereinafter. Each hinge plate 56 has an outer longitudinal edge margin 62 opposite the hinge which is received in the corresponding bent under rim 44 of the elongate plate 32. The longitudinal edge margins 62 are free to move within the rim 44 to allow pivoting movement of the hinge plates 56 on the hinge 58. The elongate plate 32 provides a small spring force to bias the hinge plates 56 away from a co-planar position (i.e., toward either the closed position or the open position). However, the tension provided by the elongate plate 32 is substantially smaller than on conventional ring binder mechanisms, and the plate provides effectively no clamping force to hold the ring members 54 in the closed position as with conventional mechanisms. The elongate plate 32 provides a force which is as small as it can be while still supporting the hinge plates 56. Each hinge plate 56 also has several locating cutouts 64 along the outer longitudinal edge margin 62 for a purpose described hereinafter.

A unique control structure indicated generally at 66 is provided for controllably pivoting the hinge plates 56 and thereby moving the ring members 54 between the closed and open positions, as well as for controllably locking the ring members at the closed position. The control structure 66 includes a single actuating lever 68 at one end of the mechanism, a travel bar 70, and two connecting links 72 which are supported by the elongate plate 32 and are movable relative to the elongate plate. The connecting links 72 operatively connect the travel bar 70 to the hinge plates 56.

The actuating lever 68 selectively moves the ring members 54 between the open and closed positions and moves the mechanism to a locked position. The lever 68 is pivotally mounted by a hinge pin 74 to one end 42 of the elongate plate 32 in a position readily accessible for grasping and moving the lever. The opposite end 42 of the elongate plate is free from any actuator, although it is understood that a mechanism with two levers does not depart from the scope of this invention. The lever 68 is operatively connected to the travel bar 70 such that application of force to the lever produces movement of the travel bar generally lengthwise of the elongate plate 32. The pivotal motion of the lever 68 provides for easier application of force by an operator when moving the travel bar 70 than it would be to translate the bar directly as by pushing or pulling, and does so without the bar protruding from the elongate plate. A suitable rigid material or combination of materials, such as metal or plastic, forms the lever 68.

An intermediate connector 76 is pivotally connected to the lever 68 and to the travel bar 70 for pivoting motion relative to both the lever and travel bar. Force is transmitted from the lever 68 to the travel bar 70 through the intermediate connector 76. The intermediate connector 76 has an elongate slot 78 for allowing the intermediate connector to move while receiving a mounting post 48 through the slot. The slot 78 allows transmission of force around the post 48 while keeping direction of force along a centerline of the intermediate connector 76. The intermediate connector 76 has a tabbed end 80 for being received in a slot 82 on an end of the travel bar 70 for permitting relative pivoting motion. A hinge pin 84 attaches the intermediate connector 76 to the lever 68.

Figure 14:
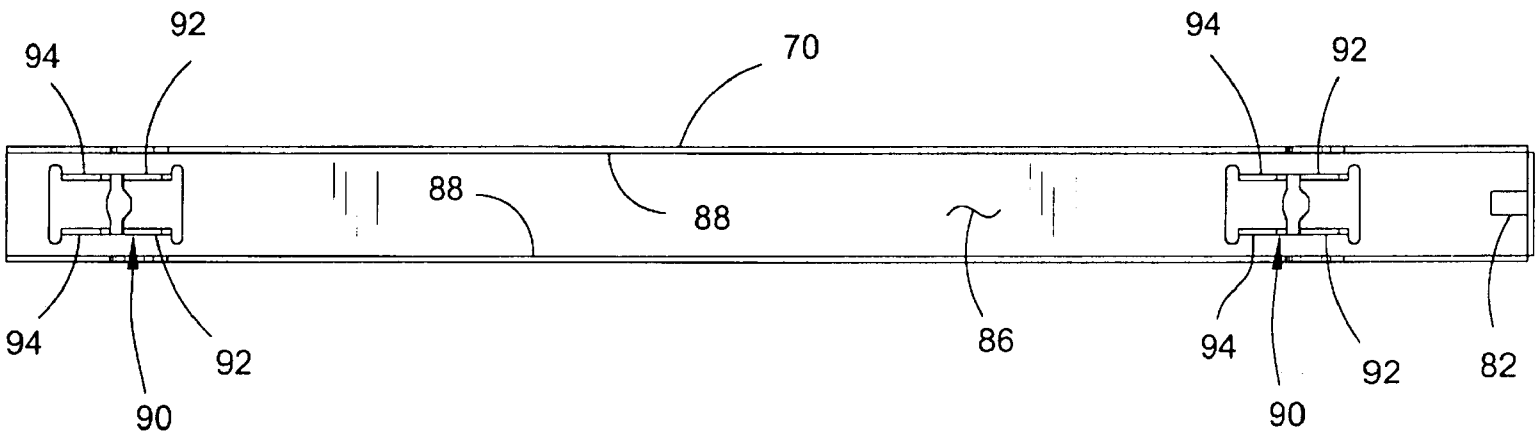
FIG. 14 is a bottom plan of a travel bar.

The travel bar 70 (FIG. 14) is elongate in shape and disposed in generally parallel arrangement with the longitudinal axis 38 of the elongate plate 32. It is movable generally lengthwise of the elongate plate, being pivotally supported by the connecting links 72. The travel bar 70 is housed within the elongate plate 32 behind the raised plateau 36 and has the shape of a rigid channel, with a flat web 86 and downwardly turned side flanges 88.

Two mounts, indicated generally at 90, are on the travel bar 70 for pivotally attaching the travel bar and connecting links 72. Each mount 90 includes stops 92, 94 (FIG. 10) formed by punching and bending portions of the web 86. Two stops 92 are arranged on a first longitudinal side of the mount 90 and two stops 94 on the opposite side. The stops limit an angular extent of pivotal motion of the connecting link 72 relative to the travel bar 70. Each stop 92, 94 has an angled surface configured for engagement by the connecting link 72. The stops are directionally configured, i.e., the angle of surfaces on stops 92 differs from the angle of surfaces on stops 94 such that a maximum relative angle between the connecting link and travel bar may be greater in one longitudinal direction than in the opposite longitudinal direction. Corresponding notches 96 (FIG. 2) are formed in the flanges 88 of the travel bar 70 at positions adjacent each mount, forming a slot transverse a longitudinal axis of the bar for permitting free pivotal motion of the connecting links 72.

Figure 12:
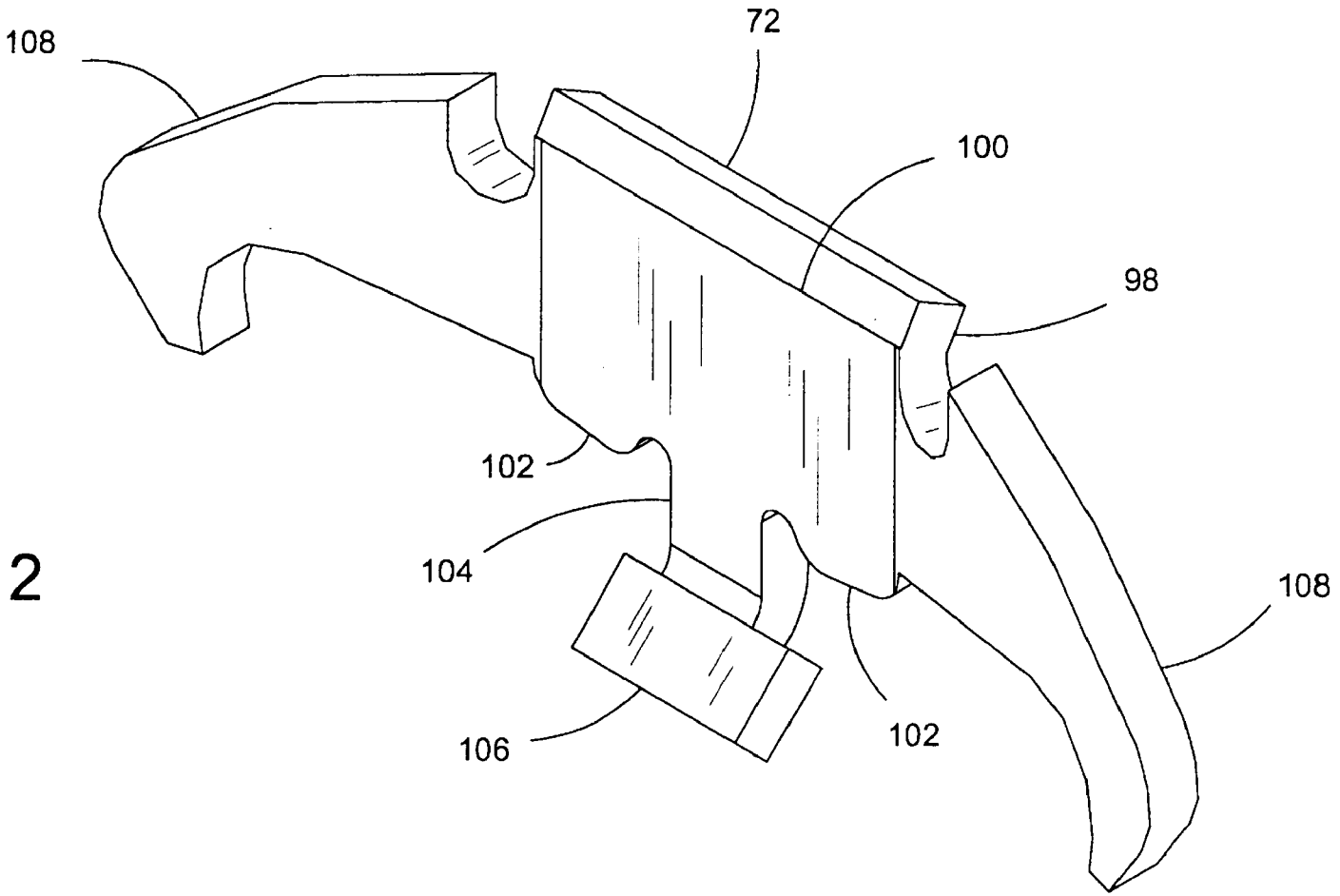
FIG. 12 is an enlarged perspective of a connecting link.

Referring to FIG. 12, each connecting link 72 has a tongue 98 projecting from the top center of the link which is pivotally received in the mount 90, between the stops 92 and 94. The tongue 98 pivots about an axis transverse to the longitudinal axis of the travel bar 70. An upper peripheral edge of the tongue 98 is generally straight and configured to engage the mount 90 for attaching the connecting link 72 to the travel bar 70 in loose fitting relation such that the bar is movable generally lengthwise of the elongate plate 32 while the connecting link pivots with respect to the elongate plate. The tongue 98 is bent at a slight angle relative to the center of the link 72, as shown at line 100 in FIG. 12. That angle inhibits occurrence of the link 72 becoming stopped at a vertical position with little or no tendency to move away from that position when force is oriented generally vertically. The connecting link 72 has two lugs 102 for engaging upper surfaces of the two hinge plates 56 adjacent to the hinge 58. A tab 104 depends from the lower center of the connecting link 72 for being received through the opening defined by the aligned notches 60 at the hinge. The tab 104 is in loose fitting relation with the hinge plates 56 for attaching the connecting link 72 to the hinge plates. A retainer 106 at the bottom of the tab 104 is wider than the opening at the notches 60 to prevent the tab 104 from being fully withdrawn from the opening. The tab 104 is configured to move toward and away from the hinge plates 56 while permitting the connecting link 72 to pivot with respect to the hinge plates. When the link 72 pivots to where the retainer 106 engages the hinge plates 56, the retainer pivots the hinge plates to move the ring members 54 to the open position.

Locating arms 108 extend laterally outwardly from opposite sides of the connecting link 72 for extending through the locating cutouts 64 in the hinge plates 56. The arms 108 attach the link 72 to the hinge plates 56 and locate the link against canting movement, that is, movement about a vertical axis perpendicular to the longitudinal axis 38 of the elongate plate 32. However, ends of the arms 108 are received sufficiently loosely in the locating cutouts 64 so as not to interfere with the pivoting motion of the connecting link 72.

Preferably, the connecting links 72 are formed of a suitable rigid material, such as metal or plastic. It is understood that mechanisms with links formed of a non-rigid material do not depart from the scope of this invention. Further, a mechanism with a different number of connecting links, greater or less than two, does not depart from the scope of this invention.

Figure 9:
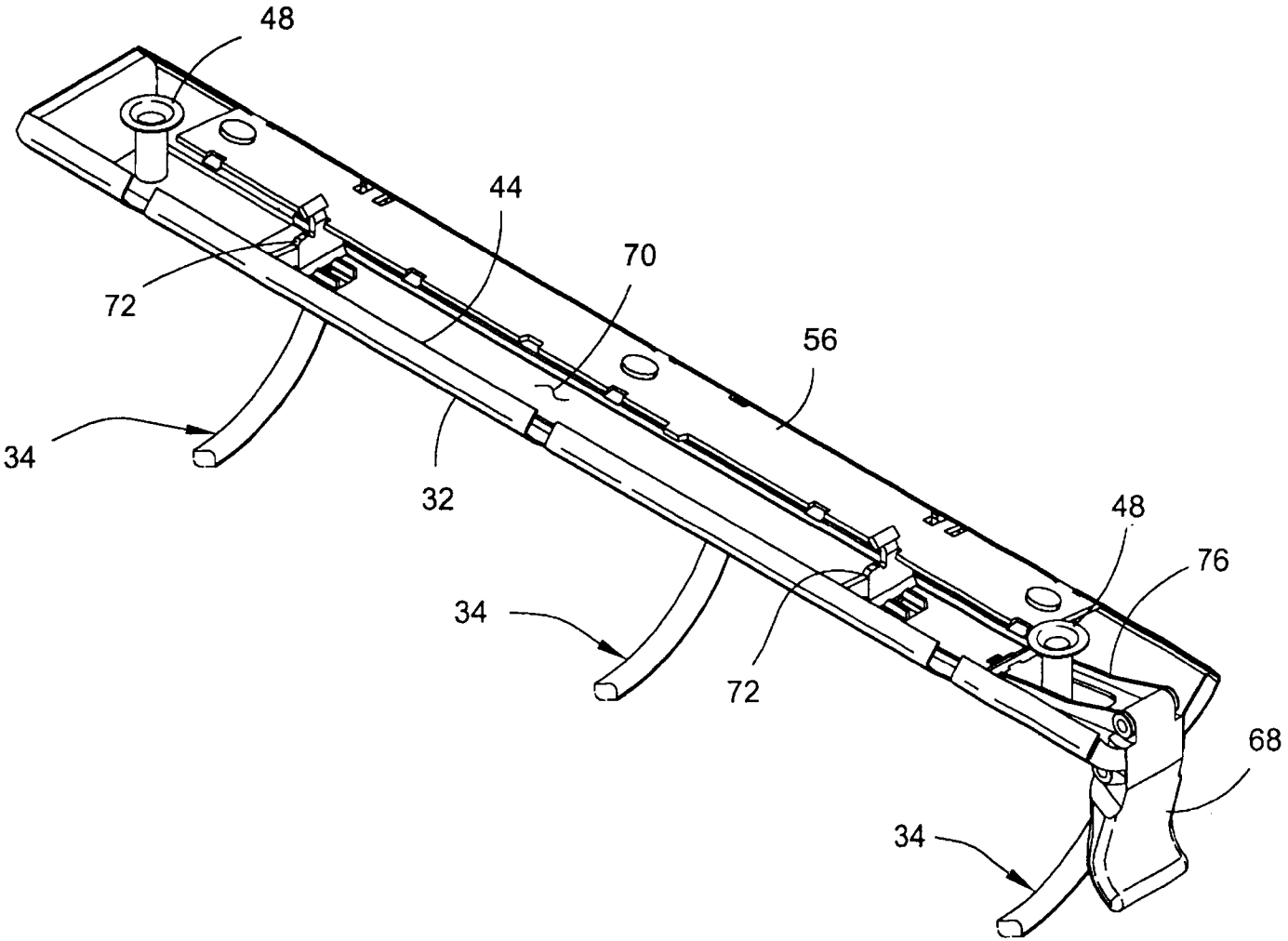
FIG. 9 is a bottom perspective of the ring binder of FIG. 1 at the closed and locked position with one hinge plate removed.
Figure 10:
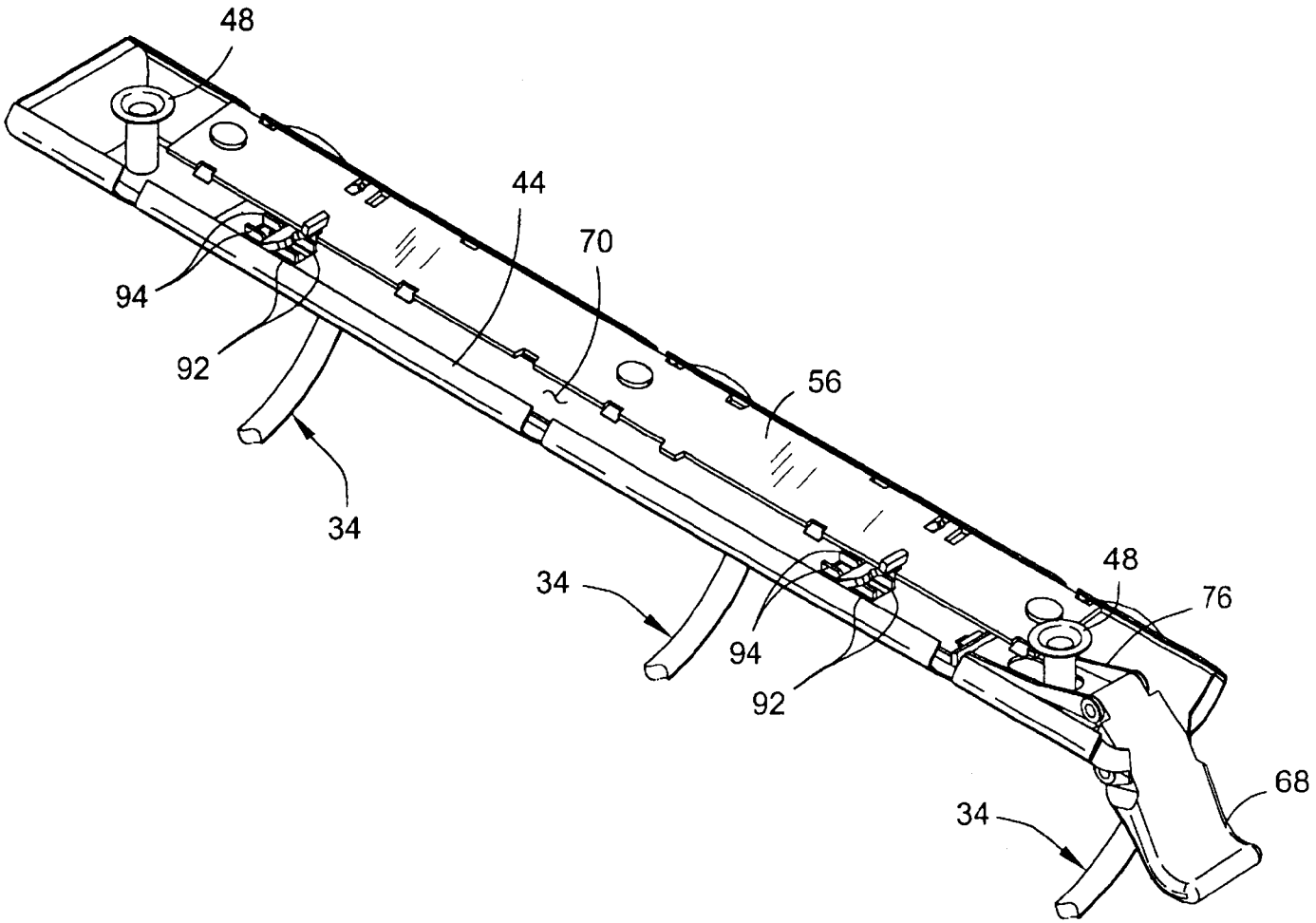
FIG. 10 is a view similar to FIG. 9 with the mechanism at the open position.

The two connecting links 72 are at spaced apart locations and positioned longitudinally relative to the rings 34 such that force applied through the lever 68 is distributed generally uniformly among the rings. As seen in FIGS. 9 and 10, there are three rings 34 and two connecting links 72, the links being symmetrically positioned in alternating relation relative to the rings to transmit force to the hinge plates 56 which is generally equally distributed among the three rings. That avoids problems of uneven force distribution to the rings as on mechanisms of the prior art. The links 72 are positioned closer to the endmost rings 34, each at a spacing between about one-fourth and one-third of the distance between the endmost and centermost rings. Other spacings do not depart from the scope of this invention.

The components of the mechanism 30 are made of a suitable rigid material, such as a metal (e.g., steel). Mechanisms made of non-metallic materials, specifically including a plastic, do not depart from the scope of this invention.

Figure 3:
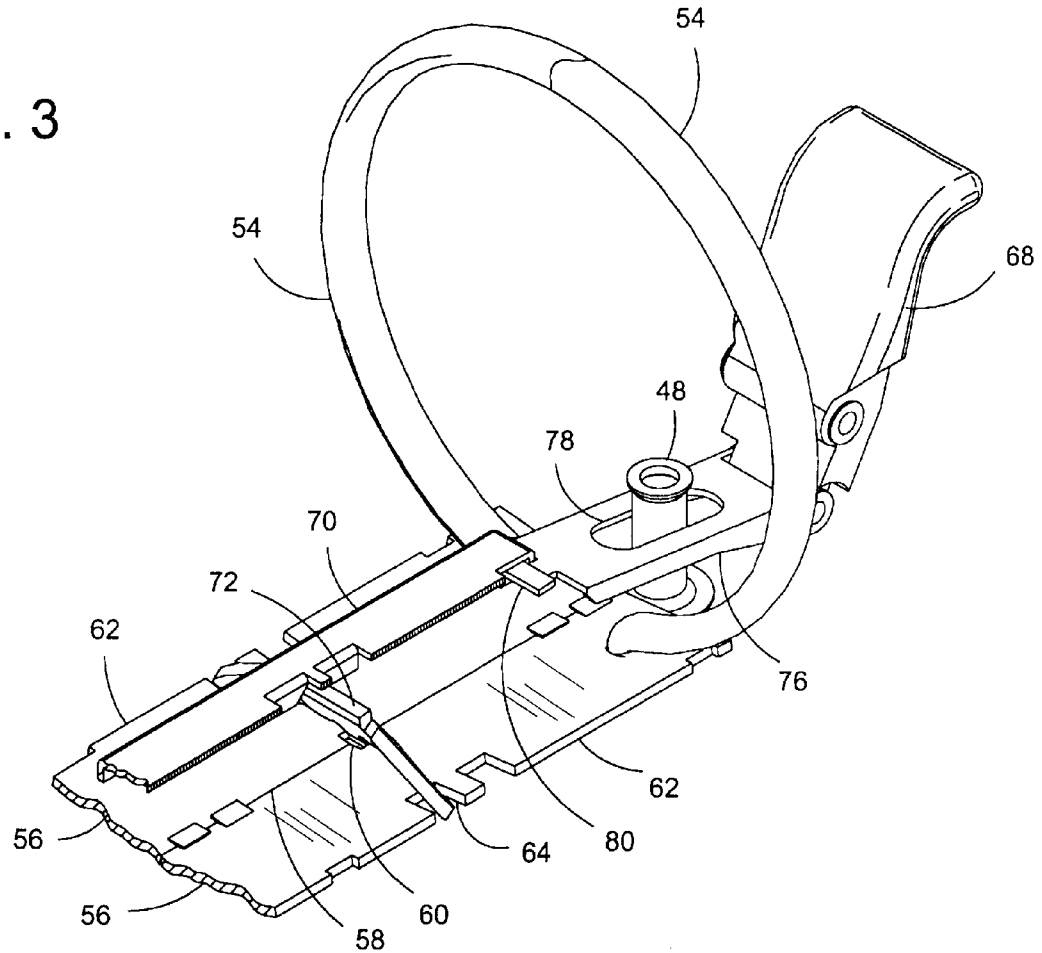
FIG. 3 is a fragmentary perspective of the mechanism with an elongate plate thereof removed and in a closed and unlocked position.
Figure 4:
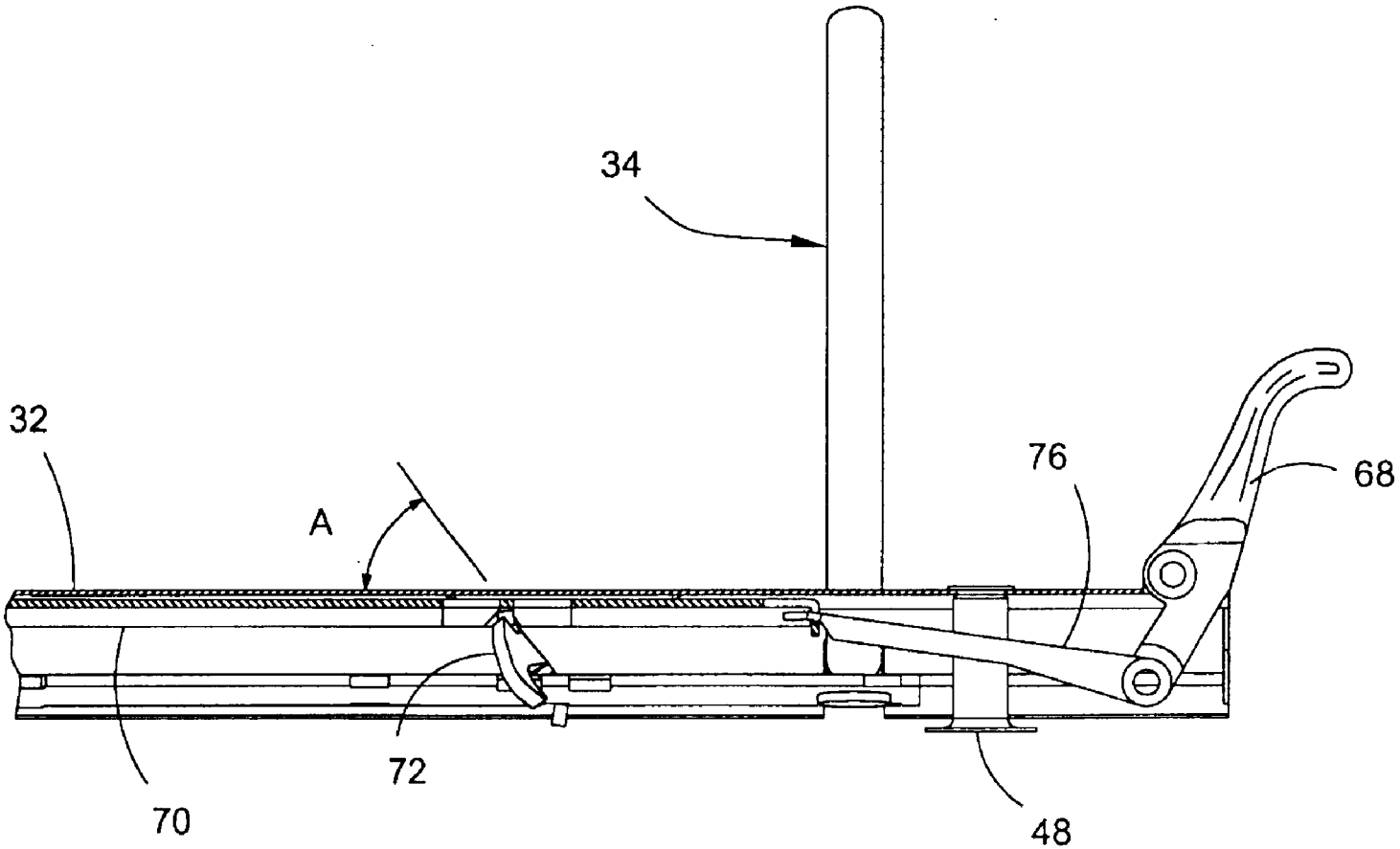
FIG. 4 is a fragmentary longitudinal section of the mechanism at the closed and unlocked position.
Figure 5:
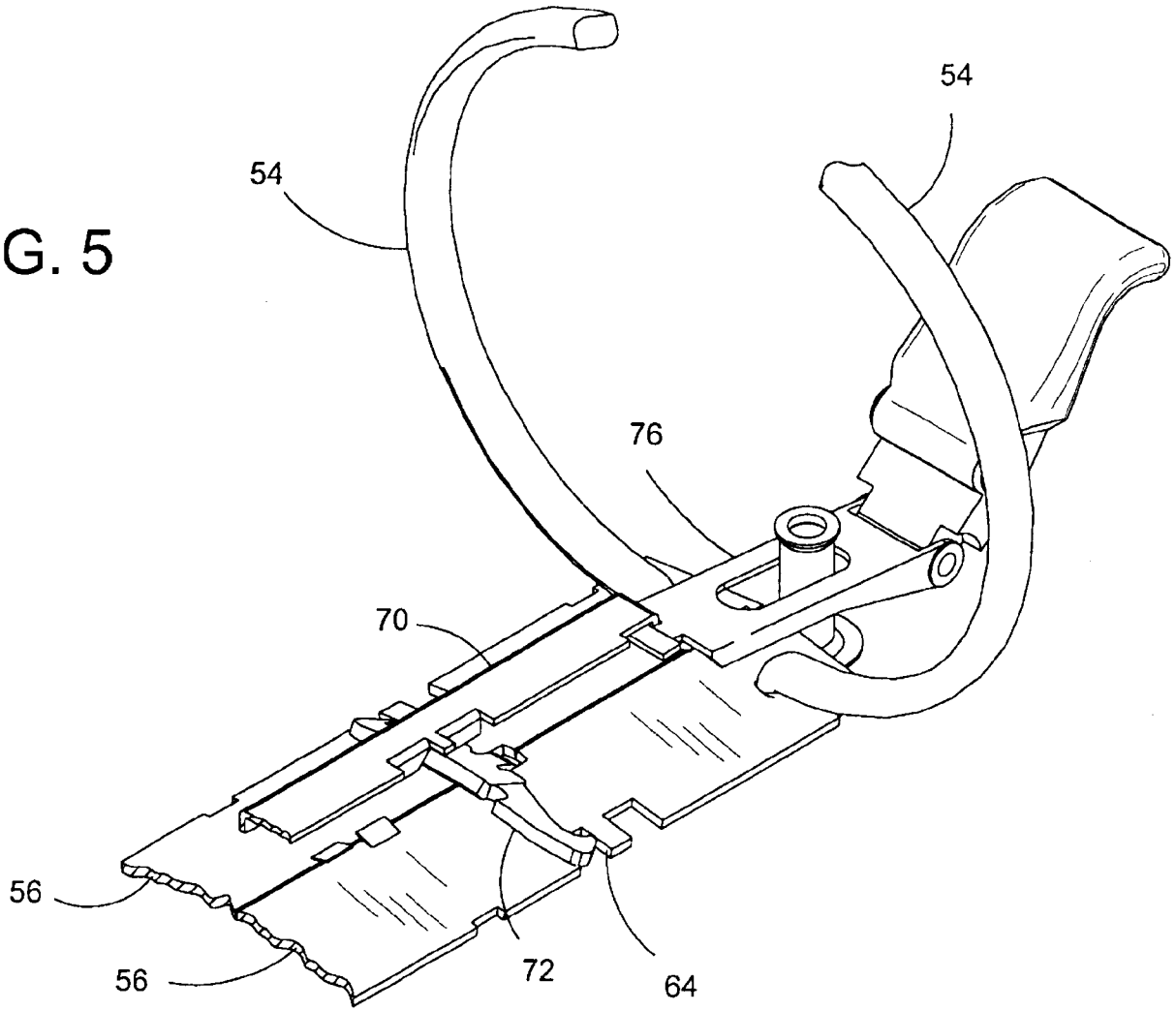
FIG. 5 is a view similar to FIG. 3 with the mechanism at an open position.
Figure 6:
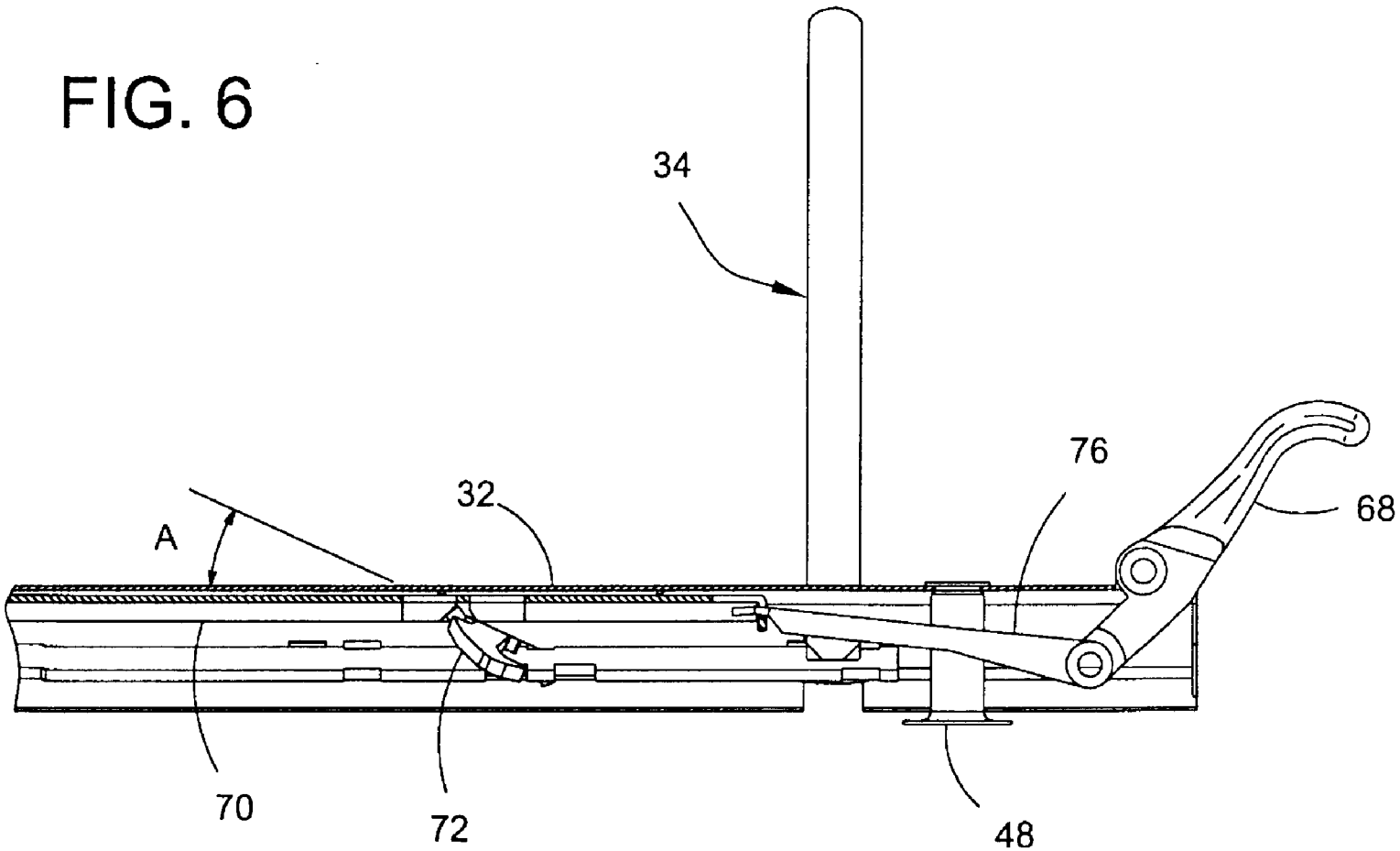
FIG. 6 is a view similar to FIG. 4 with the mechanism at the open position.
Figure 7:
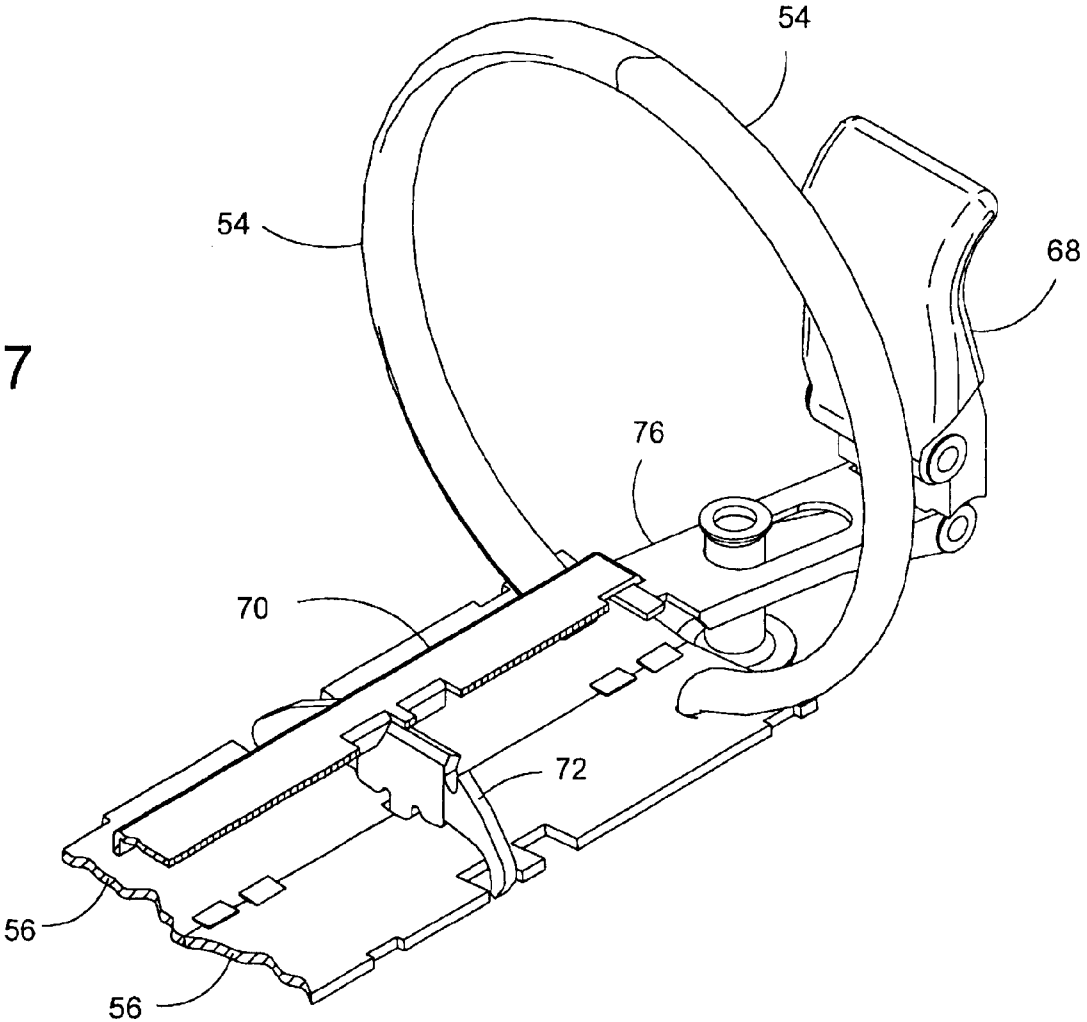
FIG. 7 is a view similar to FIG. 3 with the mechanism at a closed and locked position.
Figure 8:
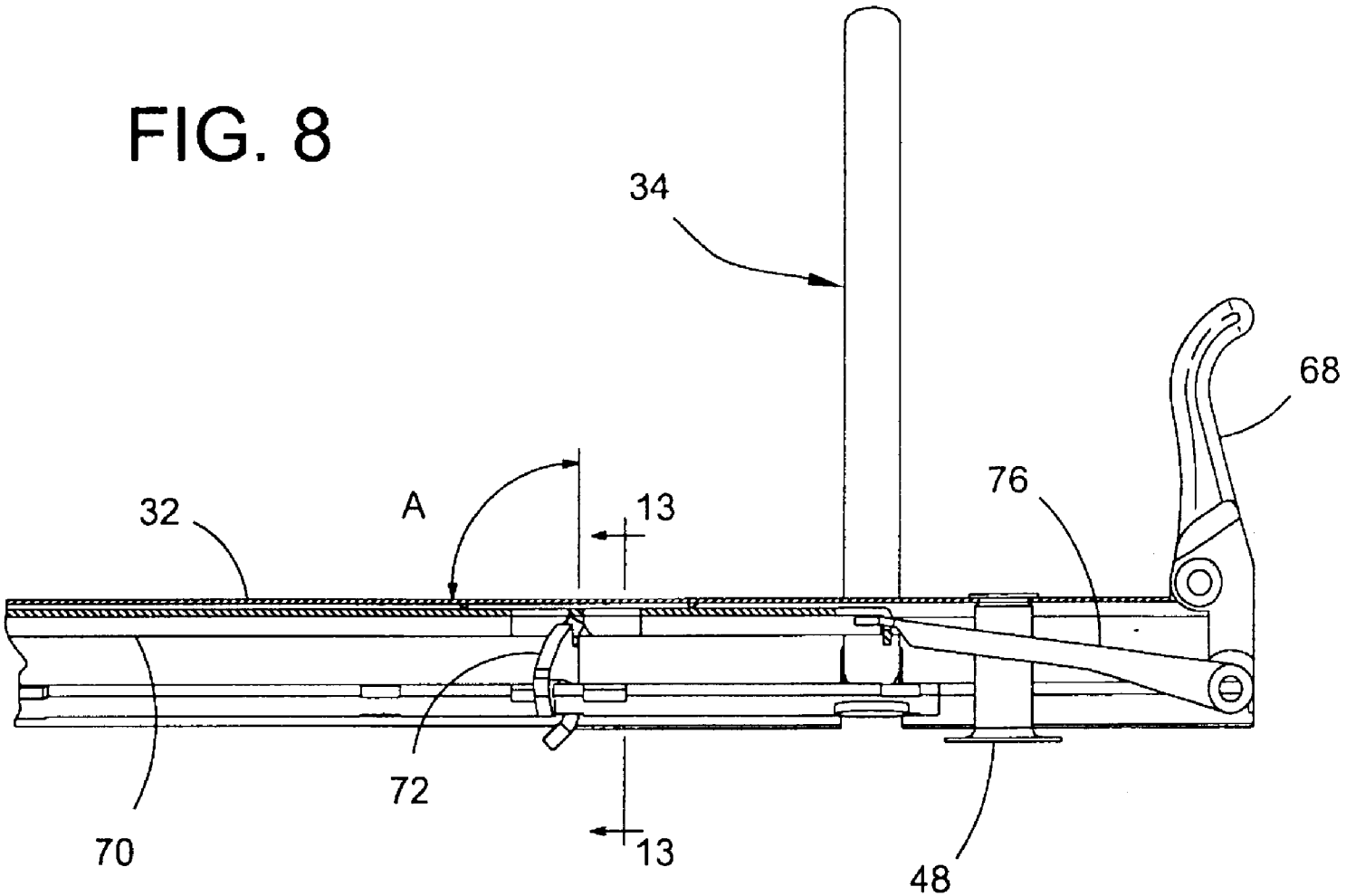
FIG. 8 is a view similar to FIG. 4 with the mechanism at the closed and locked position.

In operation, the control structure 66 is configured to selectively place the mechanism 30 at three primary positions:

First position: Ring members 54 open (FIGS. 5 and 6);

Second position: Ring members 54 closed and unlocked (FIGS. 3 and 4);

Third position: Ring members 54 closed and locked (FIGS. 7 and 8). In order to move from the first position to the second and third, an operator applies force to the lever 68 to progressively pivot the lever upwardly. That pulls the intermediate connector 76 and travel bar 70 such that they move toward the end 42 of the elongate plate 32 having the lever. As the travel bar 70 moves, both connecting links 72 are simultaneously and pivotally moved to a more upright position. For instance, typical angles A (FIGS. 4, 6, and 8) of the connecting link 72 relative to the elongate plate 32 are about 30 degrees at the first position, 45 degrees at the second position, and 95 to 100 degrees at the third position. Other angles do not depart from the scope of this invention.

The angle of the connecting links 72 in turn controls the position of the hinge plates 56. When closing the ring members 54, the lugs 102 on the connecting links engage the upper surfaces of the hinge plates 56, pushing them downward to pivot the hinge plates and thereby close the ring members. Conversely, when opening the ring members 54, the tabs 104 of the connecting links engage the lower surfaces of the hinge plates 56 to pivot the hinge plates in the opposite direction.

At the second, unlocked position, any force which tends to open the ring members 54 is not opposed. Because the hinge plates 56 receive substantially no tension from the elongate plate 32, a light finger pressure on the ring members is sufficient to move the ring members 54 to the first, open position, or back to the second, closed and unlocked position. Such force needs only overcome internal friction of the mechanism and the small spring force biasing the hinge plates 56 away from a co-planer position. There is no strong snapping motion as on conventional mechanisms. The force pivots the hinge plates 56, pushing up on the lugs 102 of the connecting links 72, and thereby pivoting the links to a different angle A.

A strong clamping force is not being applied while the ring members 54 in the rings 34 move between the first (open) and second (closed and unlocked) positions. Unlike binders of the prior art, the elongate plate 32 does not provide significant tension to the hinge plates and rings. Accordingly, the force is relatively less when the ring members are moving. That permits the ring members to be easily opened or closed using less strength by an operator. It also inhibits injury should the operator inadvertently place a finger or hand in position between ring members 54 while they are being clamped together.

Figure 13:
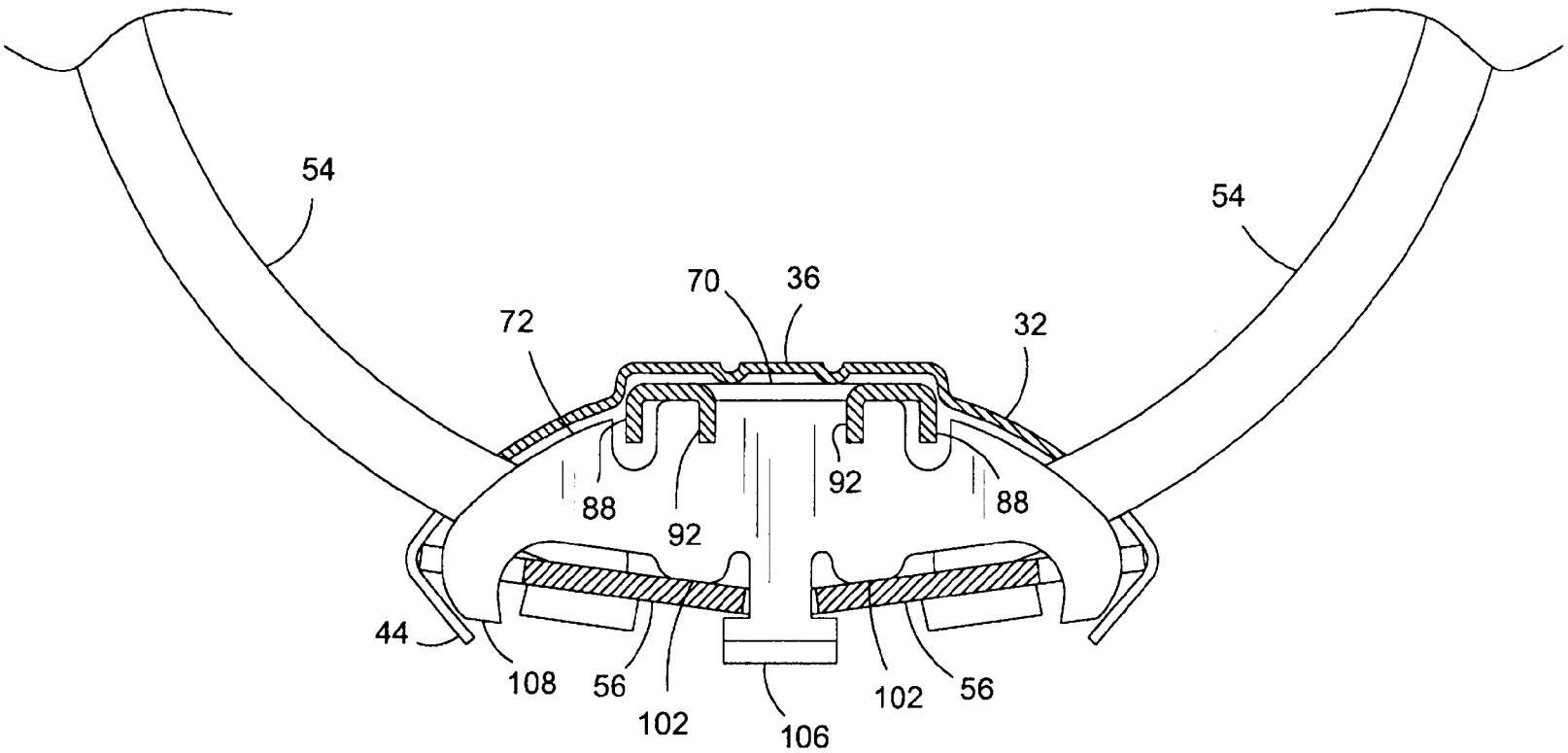
FIG. 13 is a section taken on line 13—13 of FIG. 8.

When the connecting links 72 reach an angle A of 90 degrees (not shown), which is between the second and third positions and substantially closer to the third position, the mechanism 30 is at a critical locked position. As shown in FIG. 13 for the third (locked) position, force tending to open the ring members 54 is firmly opposed by the connecting links 72 which are vertically oriented. When the hinge plates 56 push up on the lugs 102, there is little tendency to pivot or move the mechanism toward the open position because force applied to the ring members 54 urges the connecting links to move vertically upward. That motion is strongly opposed by the mechanism because the links push up on the travel bar 70 which is captured beneath the elongate plate 32. Clamping force in the rings 34 is maximized because the connecting links 72 are perpendicular between the travel bar 70 and hinge plates 56, providing a maximum spacing between those components to apply maximum force to the hinge plates. At the third, locked position the mechanism is moved to where the connecting links 72 reach an angle A slightly past the critical position (i.e., to 95 to 100 degrees) to insure stability and avoid inadvertent movement to an unlocked position. The links 72 engage the stops 92 at that position.

Figure 11:
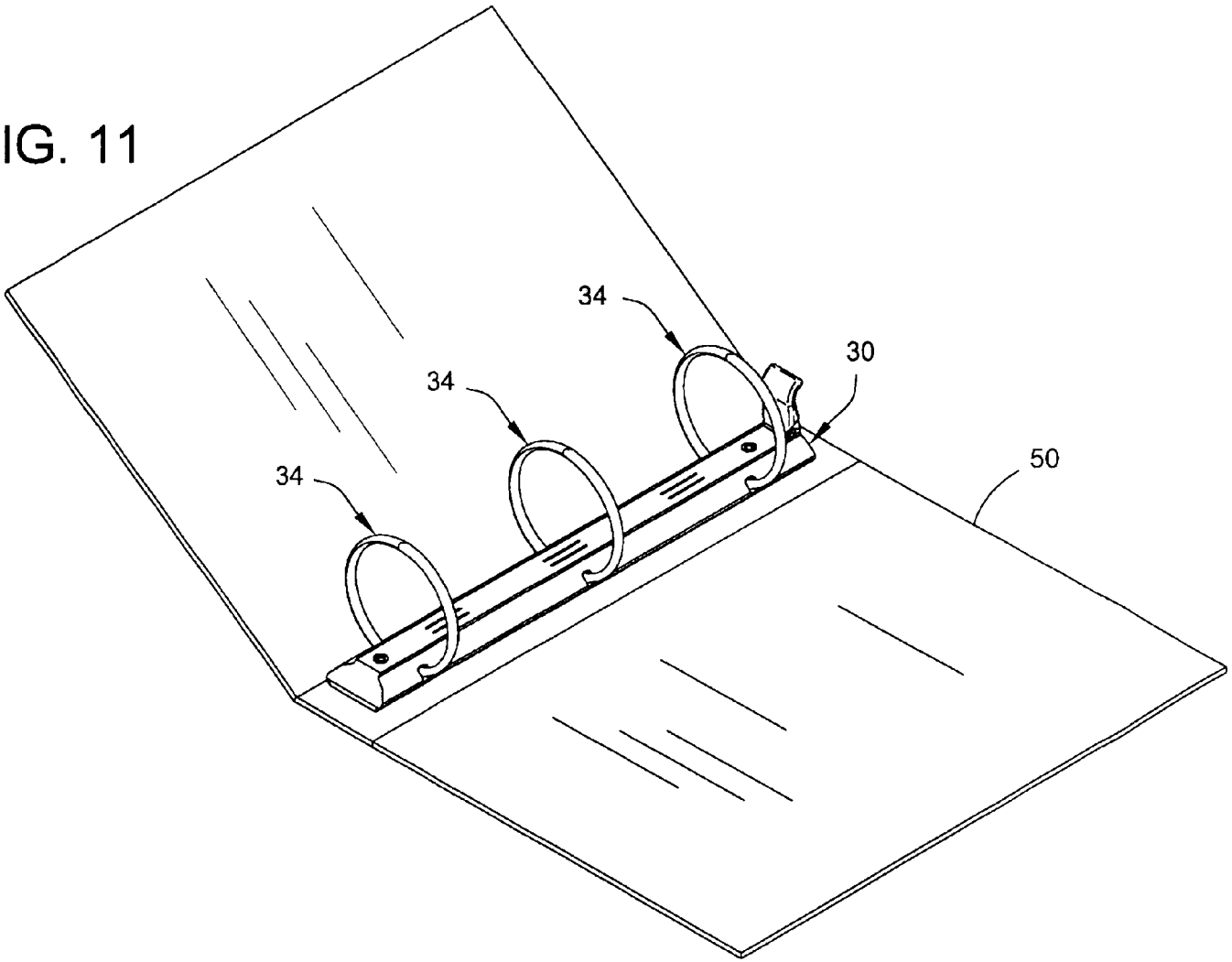
FIG. 11 is a perspective of a notebook incorporating the ring binder mechanism.

As shown in FIG. 11, the ring binder mechanism may be mounted on a cover of a notebook 50. The cover is movable to selectively cover and expose loose leaf pages retained on the rings 34.

A method according to the present invention opens or closes the ring binder mechanism 30 having ring members 54. The method comprises the steps of mounting the ring members 54 on pivotable hinge plates 56 such that pivoting of the hinge plates moves the ring members between open and closed positions. The hinge plates 56 are operatively connected with the travel bar 70 by placing at least one pivotally movable connecting link 72 between the hinge plates and the bar such that motion of the bar produces pivotal motion of the hinge plates. Force is applied to the travel bar 70 to move the bar, thereby pivoting the connecting links 72 to open or close the ring members 54. A step of locking the mechanism 30 includes applying force to the travel bar 70 to move the bar and thereby pivot the connecting links 72 to incline the connecting links to at least the critical locked position (angle A of 90 degrees or greater) wherein opening of ring members is inhibited.

The binder mechanism 30 of the present invention effectively retains loose leaf pages. The mechanism does not snap shut with a strong force which might injure a person who inadvertently places a finger or hand between ring members as they clamp together. The ring members 54 may be moved by application of force at only one end 42 of the elongate plate, and the magnitude of force is less than on ring binders of the prior art. The mechanism distributes force generally uniformly to the three rings 34. The binder may be controllably placed in a locked position for securing loose leaf sheets.

Figure 15:
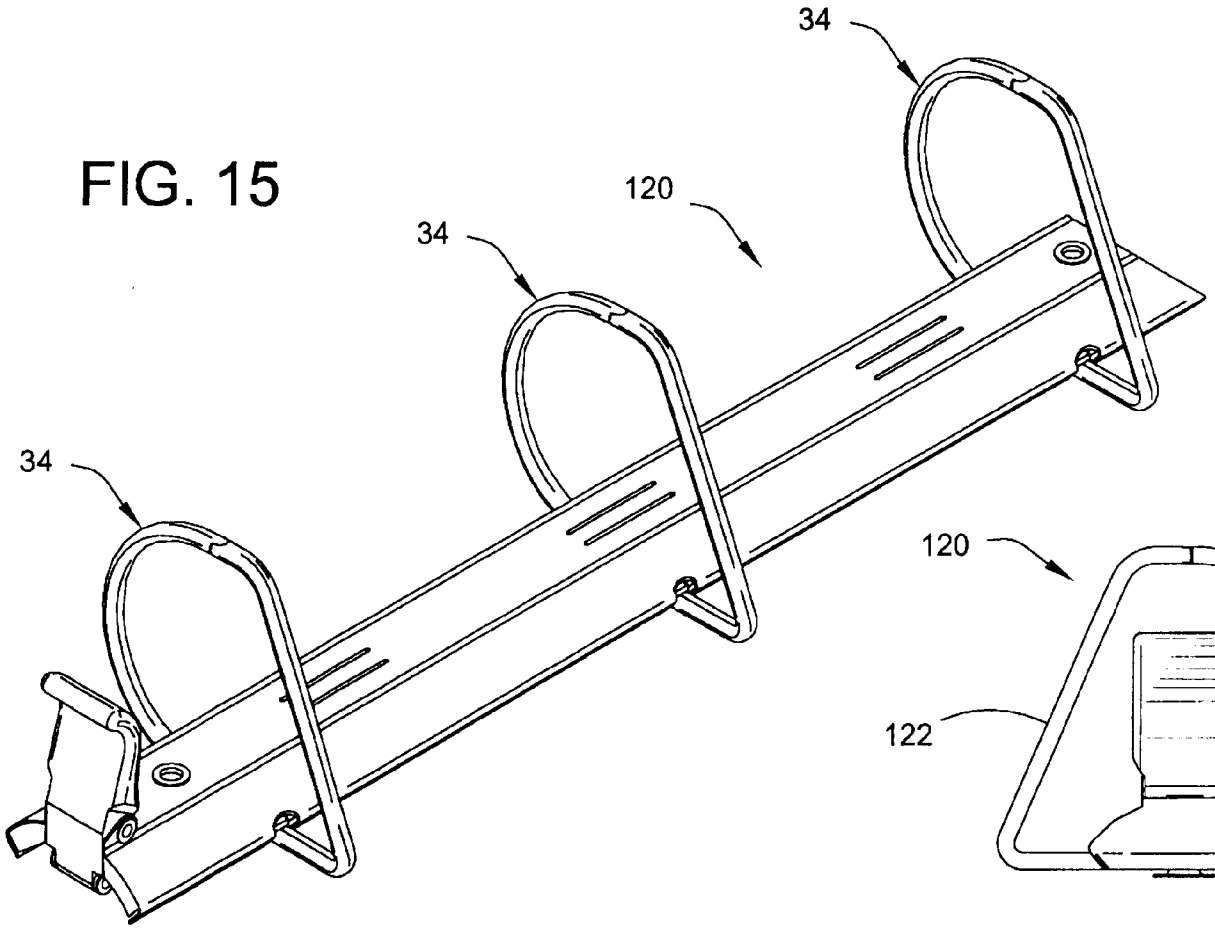
FIGS. 15 and 16 are a perspective and an end elevation, respectively, of a binder mechanism according to a second embodiment of the present invention having rings of a first slanted D shape.
Figure 16:
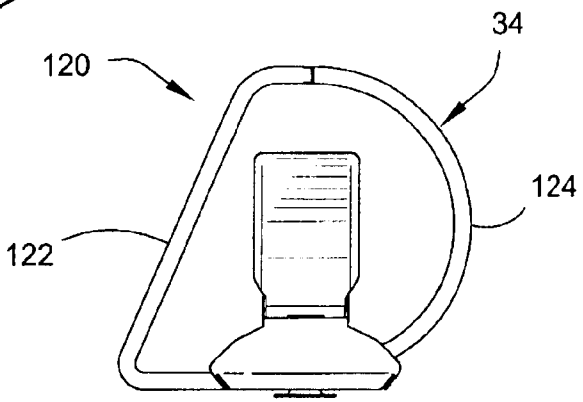

A second embodiment 120 of the present invention is shown in FIGS. 15 and 16. The rings 34 of the second embodiment have a shape generally in the form of a slanted letter D, with a first ring member 122 which is a generally straight post at an angle of inclination, and a second ring member 124 which is generally semicircular in shape.

Figure 17:
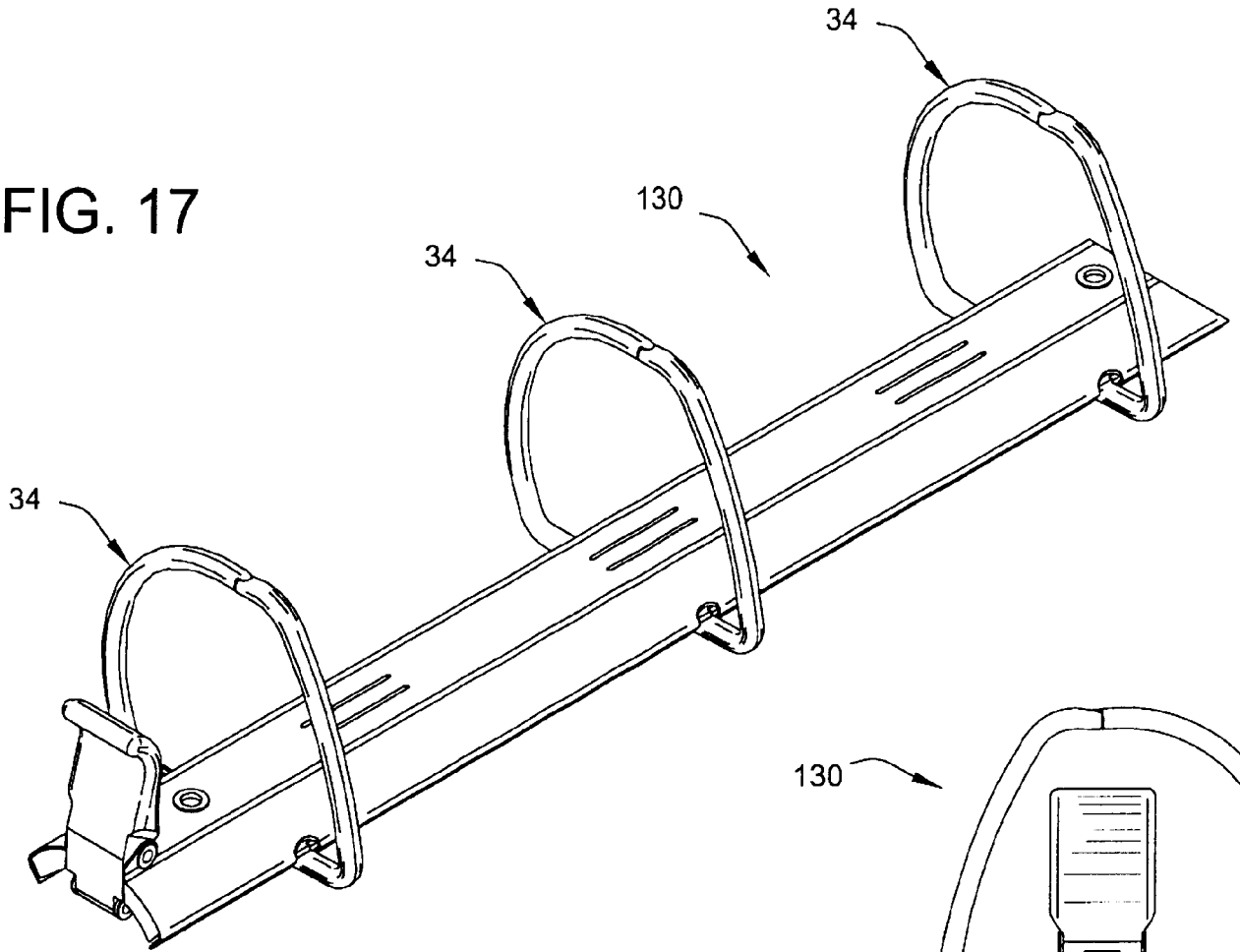
FIGS. 17 and 18 are a perspective and an end elevation, respectively, of a binder mechanism according to a third embodiment of the present invention having rings of a second slanted D shape.
Figure 18:
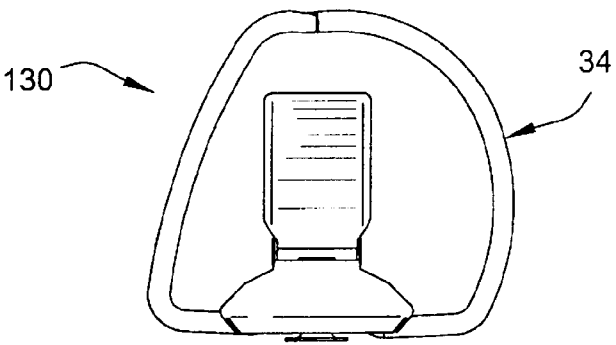

A third embodiment 130 of the present invention is shown in FIGS. 17 and 18. The rings 34 of the third embodiment have an alternate shape of another slanted D. It is understood that a mechanism having other shapes of rings does not depart from the scope of this invention.

In view of the above, it will be seen that the several objects of the invention are achieved and other advantageous results obtained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A ring binder mechanism for retaining loose leaf pages, the mechanism comprising:

a generally rigid, elongate plate having a longitudinal axis;

hinge plates supported by said plate for pivoting motion relative to the elongate plate;

rings for holding said loose leaf pages, the rings including ring members mounted on said hinge plates and moveable by the hinge plates between a closed position wherein the ring members of each ring form a substantially continuous, closed loop for allowing loose leaf pages retained by the rings to be moved along the ring from one ring member to the other, and an open position wherein the ring members of each ring form a discontinuous, open loop for adding or removing loose leaf pages from the rings; and a control structure supported by the elongate plate for movement relative to the elongate plate for controllably pivoting said hinge plates to thereby move the ring members between the closed and open positions, the control structure comprising a travel bar movable in translation relative to the elongate plate and a connecting link pivotally connecting the travel bar to the hinge plates for moving the hinge plates between said closed and open positions.

2. A ring binder mechanism as set forth in claim 1 wherein said elongate plate has two generally opposite longitudinal edges, the hinge plates being supported between said two edges with substantially no tension therebetween.

3. A ring binder mechanism as set forth in claim 1 wherein the travel bar is movable generally lengthwise of the elongate plate.

4. A ring binder mechanism as set forth in claim 3 wherein the connecting link is pivotally attached to the travel bar and pivotally attached to at least one of the hinge plates.

5. A ring binder mechanism as set forth in claim 4 wherein the travel bar is supported by the connecting link.

6. A ring binder mechanism as set forth in claim 4 wherein the connecting link is rigid.

7. A ring binder mechanism as set forth in claim 6 wherein the connecting link includes a tab received through the hinge plates in loose fitting relation therewith for attaching the connecting link to the hinge plates for movement toward and away from the hinge plate while permitting the connecting link to pivot with respect to the hinge plates.

8. A ring binder mechanism as set forth in claim 7 wherein the connecting link further comprises a tongue, the travel bar including a mount receiving the tongue for attaching the connecting plate to the travel bar in loose fitting relation for movement therewith generally lengthwise of the elongate plate while permitting the connecting link to pivot with respect to the elongate plate.

9. A ring binder mechanism as set forth in claim 8 wherein the connecting link further comprises locating arms extending laterally outwardly from opposite sides of the link and being attached to the hinge plates for locating the link against canting movement caused by pivoting about an axis perpendicular to said longitudinal axis of the elongate plate.

10. A ring binder mechanism as set forth in claim 8 wherein the control structure comprises two connecting links attached to the hinge plates and travel bar at spaced apart locations.

11. A ring binder mechanism as set forth in claim 3 wherein the control structure further comprises an actuating lever pivotally mounted on the elongate plate in a position for grasping to pivot the lever, the lever being operatively connected to the travel bar such that pivoting motion of the lever produces movement of the travel bar generally lengthwise of the elongate plate.

12. A ring binder mechanism as set forth in claim 11 wherein the control structure further comprises an intermediate connector pivotally connected to the lever and to the travel bar for pivoting motion relative to both the lever and travel bar.

13. A ring binder mechanism as set forth in claim 12 wherein the intermediate connector has an elongate slot therein, and wherein the ring binder mechanism further comprises a mounting post for use in mounting the ring binder mechanism on a cover, the post being received through the slot.

14. A ring binder mechanism as set forth in claim 3 wherein the control structure is configured to selectively place the mechanism in a locked position wherein the ring members are securely closed, the travel bar being moveable from a first position corresponding with the ring members being at the open position, to a second position corresponding with the ring members being at the closed position, and to a third position beyond the second position where the ring members remain closed and the mechanism is locked.

15. A ring binder mechanism as set forth in claim 1 in combination with a cover, the ring binder mechanism being mounted on the cover, the cover being movable to selectively cover and expose loose leaf pages retained on the rings.

16. A ring binder mechanism as set forth in claim 1 wherein said rings have a generally circular shape.

17. A ring binder mechanism as set forth in claim 1 wherein said rings have a generally slanted D shape.

18. A ring binder mechanism for retaining loose leaf pages, the mechanism comprising:

a generally rigid, elongate plate having a longitudinal axis and two ends;

hinge plates supported by said elongate plate for pivoting motion relative to the elongate plate;

rings for holding said loose leaf pages, the rings including ring members mounted on said hinge plates and moveable by the hinge plates between a closed position wherein the ring members of each ring form a substantially continuous, closed loop for allowing loose leaf pages retained by the rings to be moved along the ring from one ring member to the other, and an open position wherein the ring members of each ring form a discontinuous, open loop for adding or removing loose leaf pages from the rings; and a control structure supported by the elongate plate for movement relative to the elongate plate, the control structure comprising a pivotally movable actuator located generally at one end of the elongate plate and pivotally mounted thereto, the other end being free of any actuator, the control structure engaging the hinge plates at least at two spaced apart locations for controllably pivoting said hinge plates to thereby move the ring members between the closed and open positions, the control structure further comprising a travel bar movable in translation generally lengthwise of the elongate plate and two connecting links pivotally connecting the travel bar to said hinge plates at said two spaced apart locations.

19. A ring binder mechanism as set forth in claim 18 wherein the control structure is configured to selectively place the mechanism in a locked position wherein the ring members are securely closed, the actuator being moveable from a first position corresponding with the ring members being at the open position, to a second position corresponding with the ring members being at the closed position, and to a third position beyond the second position where the ring members remain closed and the mechanism is locked.

20. A method of opening or closing a ring binder mechanism having ring members for retaining loose leaf pages and an elongate support plate, the method comprising the steps of:

mounting said ring members on pivotable hinge plates such that pivoting of the hinge plates moves the ring members between open and closed positions;

operatively connecting said hinge plates with a travel bar that is moveable in translation generally lengthwise of said elongate plate, including placing at least one pivotally movable connecting link between the hinge plates and the travel bar such that force is transmitted from the bar to the hinge plates to produce pivotal motion of the hinge plates; and applying force to said actuating bar to move the bar and thereby open or close the ring members.

21. A method as set forth in claim 20 further comprising a step of locking the mechanism by applying force to said travel bar to move the bar and thereby pivot said at least one connecting link to incline the link to a position wherein opening of ring members is inhibited.

* * * * *